US008857107B1

(12) United States Patent
Key

(10) Patent No.: US 8,857,107 B1
(45) Date of Patent: Oct. 14, 2014

(54) DOOR THRESHOLD SHIELD APPARATUS

(71) Applicant: Daniel Key, Pewee Valley, KY (US)

(72) Inventor: Daniel Key, Pewee Valley, KY (US)

( * ) Notice: Subject to any disclaimer, the term of this patent is extended or adjusted under 35 U.S.C. 154(b) by 0 days.

(21) Appl. No.: 13/973,809

(22) Filed: Aug. 22, 2013

(51) Int. Cl.
*E05B 1/00* (2006.01)

(52) U.S. Cl.
USPC ..... 49/460; 49/467; 52/3; 52/12; 52/211

(58) Field of Classification Search
USPC ..... 49/460, 467, 468; 52/DIG. 12 X, 3 X, 52/211 X, 212, 179
See application file for complete search history.

(56) References Cited

U.S. PATENT DOCUMENTS

| | | | | |
|---|---|---|---|---|
| 4,079,550 | A * | 3/1978 | Bursk et al. | 49/467 |
| 5,588,266 | A | 12/1996 | Headrick | |
| 5,611,173 | A | 3/1997 | Headrick et al. | |
| 6,044,600 | A * | 4/2000 | McCollough | 52/209 |
| 6,216,395 | B1 | 4/2001 | Kelly | |
| 6,269,591 | B1 * | 8/2001 | Kelly | 49/482.1 |
| 6,829,864 | B2 * | 12/2004 | Mitchell et al. | 52/211 |
| 7,062,881 | B2 | 6/2006 | Rissone | |
| D627,488 | S | 11/2010 | Abdollahzadeh et al. | |
| D638,142 | S | 5/2011 | Van Camp et al. | |
| 8,418,426 | B2 | 4/2013 | Rissone | |
| 8,443,554 | B1 * | 5/2013 | Teodorovich | 49/506 |
| 8,567,128 | B2 * | 10/2013 | Van Camp et al. | 49/468 |
| D701,323 | S * | 3/2014 | Fortun et al. | D25/48.2 |
| 2006/0005470 | A1 * | 1/2006 | Mullen et al. | 49/467 |
| 2012/0085037 | A1 | 4/2012 | Van Camp et al. | |
| 2013/0091776 | A1 | 4/2013 | Van Camp et al. | |

FOREIGN PATENT DOCUMENTS

| | | | |
|---|---|---|---|
| GB | 2418448 | A | 3/2006 |

* cited by examiner

*Primary Examiner* — Jerry Redman
(74) *Attorney, Agent, or Firm* — Waddey & Patterson; Matthew C. Cox

(57) ABSTRACT

A door threshold shield apparatus includes a shield body shaped for covering a portion of a door threshold. The shield body can include a sheet metal or other suitable material. A hook is positioned on a first longitudinal edge of the shield body for retaining the shield body on a first edge of the threshold, and a cap flange is positioned on a second longitudinal edge of the shield body. The cap flange is shaped to be received between a removable cap flange on the threshold and a threshold base, thereby rigidly securing the shield apparatus to the threshold. Once construction is complete, the shield may be removed without removing the threshold base by detaching the threshold cap.

9 Claims, 7 Drawing Sheets

DOOR THRESHOLD SHIELD APPARATUS

TECHNICAL FIELD

The present invention pertains generally to door thresholds and more particularly to protective covers for door thresholds.

BACKGROUND

Door thresholds are used in residential and commercial construction projects to provide a floor covering and support underneath a door. Door thresholds may be referred to as doorsills in some applications. When a door is closed, it is generally desirable for the lower horizontal edge of the door to approach the structure underneath the door in a close gap fit or seal to prevent air drafts, heating, cooling, and/or foreign objects such as insects, weather, or debris from easily passing underneath the door.

Many conventional door thresholds include a wood, metal or composite threshold base that is fixed to a floor or subfloor. The threshold base provides a raised portion in some embodiments that may be locally taller than the surrounding floor. This allows a better seal against the lower edge of the door. Conventional threshold bases may include a threshold base having a base support as well as a tread plate positioned over the base support. Tread plates typically include aluminum or other types of metal, wood, plastic, composite, or other suitable materials and may include a grooved or treaded surface to provide traction when a user steps on the tread plate. Tread plates and/or threshold bases of conventional thresholds generally include a finished surface to be visible when the construction of the door and flooring is complete.

Conventional thresholds also typically include a longitudinal strip of material known as a threshold cap that sits atop the threshold base. The threshold cap may be located directly under the door when the door is closed to provide an optimal gap fit or seal between the threshold cap and the lower edge of the door. The cap may be vertically adjustable in some embodiments to optimize the spacing between the cap and the lower door edge.

Conventional thresholds may be provided as a kit or assembly, including both the threshold cap and the threshold base, wherein the threshold base has base support and tread plate pre-installed thereon. The assembly may be installed in a building during a construction process before or during installation of the door jamb or adjacent framing. It is often necessary to install the threshold assembly before a construction project is complete to allow the door frame carpentry to properly surround the threshold and to allow the flooring to be installed. This means the threshold is fixed in place and is typically not easily removable from a finished door jamb once the surrounding hardware and floor is installed. As such, removal of a door threshold after it has been installed, and after surrounding construction is complete, often requires removal of significant portions of the local door jamb structure and/or flooring.

One problem associated with conventional door thresholds and door threshold assemblies includes physical or cosmetic damage and wear to the threshold base and/or tread plate after the threshold has been installed but before construction is complete. For example, after a threshold has been installed, workers typically continue to work on the surrounding construction. This causes workers to repeatedly walk across and move equipment across the threshold base and/or tread plate, causing inadvertent damage. This damage is often noticeable after the construction job is complete when the surrounding door, door jamb, flooring, and trip carpentry is finished. A damaged threshold base or tread plate from post-installation wear is unsightly and is generally unacceptable to new construction customers. In many applications, customers may demand workers to replace damaged thresholds and/or tread plates after the surrounding construction is complete. In a large building project, this could include replacement of several thresholds. Such replacement requires expensive and timely deconstruction of adjacent door jamb members and/or flooring, resulting in additional cost and time for a construction project.

Others have attempted to overcome the problems of post-installation threshold base and tread plate damage and wear by providing protective film covers on threshold assemblies to prevent damage. For example, some conventional thresholds include a film or removable plastic layer stuck on the threshold base or tread plate. This type of removable layer typically allows a user to peel back the protective film after the surrounding construction is complete. However, such films are often too thin and are inadequate to prevent scratching or denting of threshold bases and tread plates during post-installation use by construction workers. Additionally, such films may begin to peel back prematurely due to wear across the threshold.

Others have attempted to overcome these problems by providing removable plastic shields or covers that may be used to cover a threshold base and cap after installation. Such covers may clip into place on the exterior perimeter of the threshold assembly or tread plate, fitting over both the threshold cap and the threshold base. However, such conventional plastic covers are difficult to keep on the threshold as workers repeatedly walk over the threshold, and these types of covers often become dislodged after installation. When the cover is dislodged, it provides no protection to the threshold base and/or tread plate. Thus, these types of conventional covers are generally inadequate for providing protection to threshold bases and tread plates.

What is needed then are improvements in protective devices for covering thresholds on a construction site.

BRIEF SUMMARY

The present invention in some embodiments provides a shield apparatus for covering a threshold assembly of the type having a threshold base and a removable threshold cap.

The shield apparatus includes a shield body shaped to be positioned over a portion of the threshold base, the shield body having first and second longitudinal edges. A hook extends downwardly from a first longitudinal edge of the shield body, and a cap flange protrudes from a second longitudinal edge of the shield body opposite the first longitudinal edge. The cap flange is shaped to be positioned between the threshold cap and the threshold base when the threshold cap is installed on the threshold base. The cap flange may be clamped between the threshold cap and the threshold base to rigidly secure the shield apparatus to the threshold. The hook is shaped to fit underneath a longitudinal edge of the threshold base opposite the cap flange.

In additional embodiments, the present invention provides a shield apparatus for covering a threshold, the threshold having a threshold base and a removable threshold cap. The shield apparatus includes a shield body shaped to cover a portion of the threshold base, the shield body having first and second opposing longitudinal edges. A hook flange protrudes from the shield in a position to extend under a longitudinal edge of the threshold base. A cap flange extends from the second longitudinal edge of the shield body opposite the hook flange. The cap flange is shaped to be positioned between the threshold cap and the threshold base for securing the shield to the threshold base.

Another embodiment of the present invention provides a threshold apparatus, including a threshold base, a removable threshold cap positioned on the threshold base, and a shield positioned over the threshold base. The shield includes a shield body covering a portion of the threshold base and a cap flange protruding from the shield body. The cap flange is positioned between the threshold base and the threshold cap.

A further object of the present invention is to provide a threshold shield that can be installed onto a threshold base at a construction location.

Another object of the present invention is to provide a threshold shield that can be rigidly secured to a threshold by clamping a portion of the threshold shield between structural features on the threshold.

A further object of the present invention is to provide a threshold shield that can be rigidly secured to a threshold during or before installation of the threshold but can be removed from the threshold after construction is complete.

Yet another object of the present invention is to provide a threshold assembly including a threshold with a detachable threshold shield installed thereon.

Numerous other objects, features and advantages of the present disclosure will be readily apparent to those skilled in the art upon a reading of the following description when taken in conjunction with the accompanying drawings.

DETAILED DESCRIPTION

Figure 1:
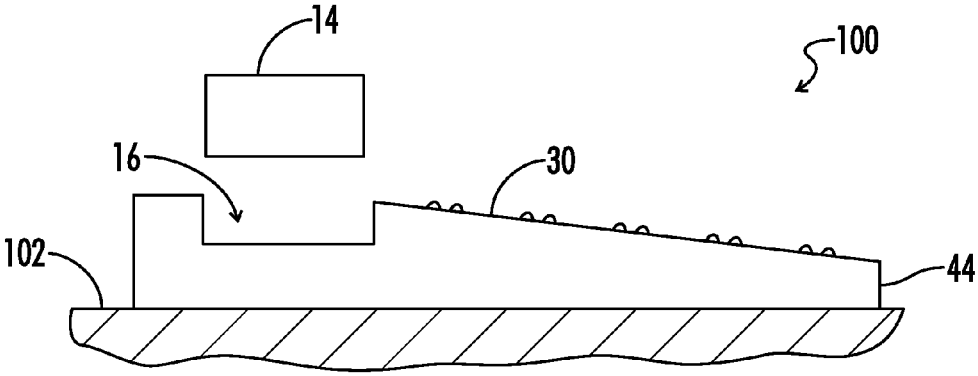
FIG. 1 illustrates a partially exploded side elevation view of an embodiment of a conventional threshold assembly having a threshold base and a threshold cap.

Referring now to the drawings, FIG. 1 illustrates an embodiment of a conventional threshold 100 including a threshold base 30 and a removable threshold cap 14. The threshold base 30 can include any suitable threshold material such as wood, plastic, metal, etc. Threshold base 30 in some embodiments may have one or more treads or surface roughing disposed on the upper surface to provide enhanced traction to people walking over the threshold. Threshold base 30 may be secured directly to a floor or subfloor in a construction application. As seen in FIG. 1, threshold base 30 includes a removable threshold cap 14. Threshold cap 14 provides a longitudinal strip of material that may be mounted on the upper surface of threshold base 30. Threshold cap 14 is generally located on threshold base 30 to align with the lower edge of a door when closed over threshold 100. Threshold cap 14 can include any suitable material such as wood, plastic, metal, etc. Threshold cap 14 may also be vertically adjustable relative to threshold base 30 in some applications to allow an enhanced engagement with a lower edge of a door positioned above threshold 100.

Also seen in FIG. 1, in some embodiments, threshold base 30 includes a longitudinal front base edge 44. Front base edge 44 may be referred to as a threshold nose in some applications. Front base edge 44 may fit flushly against floor 102 in some applications, or it may be raised slightly above the floor in other applications. Additionally, threshold base 30 may include multiple components such as a base support 30*a* and a tread plate 12, as seen in FIGS. 3-7A.

Figure 2:
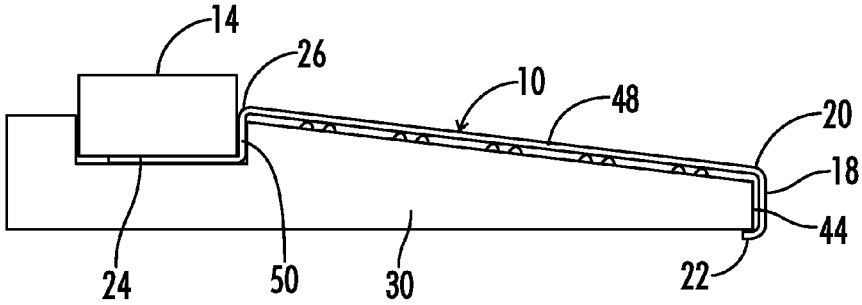
FIG. 2 illustrates a side elevation view of an embodiment of a threshold shield in accordance with the present invention disposed on the threshold assembly of FIG. 1.

In some embodiments, the present invention provides a threshold shield apparatus 10, seen in FIG. 2, shaped to cover threshold base 30 to prevent damage to threshold base 30. Threshold shield apparatus 10 generally includes a shield body 48 including a substantially flat or slightly curved sheet of material shaped and sized to fit over the exposed upper portion of threshold base 30. Shield body 48 generally includes a first longitudinal edge 20 positioned near front base edge 44 on threshold base 30 when shield apparatus 10 is installed on threshold base 30. Shield body 48 also includes a second longitudinal edge 26 positioned opposite first longitudinal edge 20. Shield body 48 may include any suitable material such as plastic, metal, wood, composite, etc. Shield body 48 can include a stamped or extruded metal sheet in some applications. Shield body 48 is dimensioned to cover a portion of threshold base 30.

As seen in FIG. 2, a hook 18 extends downwardly from first longitudinal edge 20 on shield body 48 in some embodiments. Hook 18 may alternatively be described as a retaining member or lip that protrudes generally downwardly from and back underneath a longitudinal edge of shield body 48. Hook 18 provides a retainer for securing shield 10 onto a longitudinal edge of threshold base 30, such as the front base edge 44 of threshold base 30 shown in FIG. 2 or the tread plate front edge 46 shown in FIG. 7A. Hook 18 may include a continuous longitudinal flange folded downwardly from first longitudinal edge 20 on shield body 48. As such, hook 18 may be integrally formed on shield 10 in a unitary construction simply by folding an integral portion of the shield body 48 downwardly such that it will engage a portion of threshold base 30. Alternatively, hook 18 may include a separate structure installed on shield body 48 to provide the desired retaining functionality. As seen in FIG. 2, in some embodiments, hook 18 includes one or more sheet metal bends formed in shield body 48. A first bend is located at first longitudinal edge 20 on shield body 48, and a second bend is located below the first bend resulting in a hook flange 22 extending in a reverse direction to be situated under the longitudinal edge of threshold base 30 when the shield 10 is installed on the threshold base 30.

Referring further to FIG. 2, in some embodiments, a cap flange 24 extends from second longitudinal edge 26 on shield body 48. Cap flange 24 includes a structure protruding from shield body 48 shaped to be positioned between threshold cap 14 and a portion of threshold base 30 when shield 10 is installed on threshold base 30. The term cap flange 24 generally refers to a portion of the shield 10 that protrudes from the area covering threshold base 30 and is located between threshold cap 14 and threshold base 30. Cap flange 24 in some embodiments includes an integral portion of shield body 48 shaped to fit into a region between a portion of threshold cap 14 and threshold base 30. For example, cap flange 24 may include an integral portion of sheet metal extending from shield body 48 opposite hook 18. As such, cap flange 24 may be integrally formed onto shield 10 using one or more longitudinal sheet metal bends formed in the shield 10.

As seen in FIG. 2, in some embodiments, a cap channel 16 is defined in threshold base 30, and cap flange 24 is shaped to be positioned at least partially in cap channel 16 between threshold cap 14 and threshold base 30 when shield 10 is installed on threshold base 30. To accommodate this, an offset member 50 may be positioned between cap flange 24 and shield body 48 in some embodiments. As such, cap flange 24 extends from second longitudinal edge 26 on shield body 48, as both cap flange 24 and intermediate offset member 50 both extend from the second longitudinal edge 26 on shield body 48.

Offset member 50 extends downwardly from second longitudinal edge 26 as seen in FIG. 2 to lower the position of cap flange 24 such that cap flange 24 is received between the underside of threshold cap 14 and threshold base 30 in some embodiments. In some alternative embodiments, offset member 50 may extend upwardly from second longitudinal edge 26 to raise cap flange 24 relative to shield body 48, especially in embodiments where threshold cap 14 is positioned not in a recessed channel but rather on a raised portion of threshold base 30.

Figure 3:
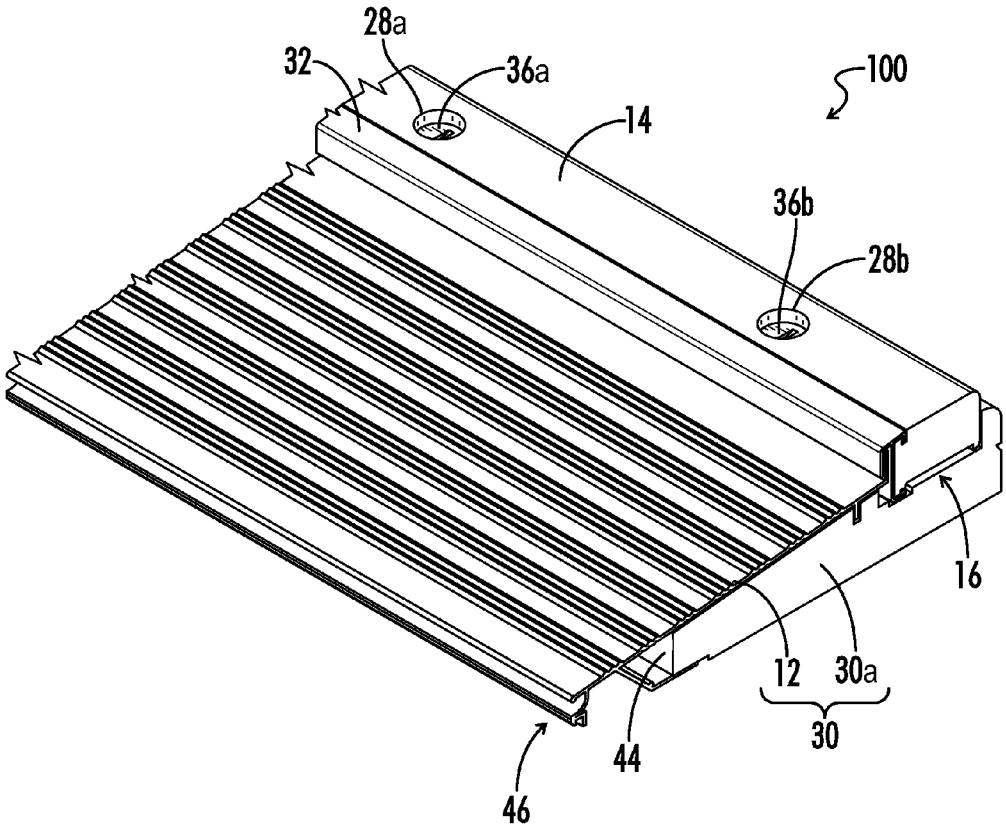
FIG. 3 illustrates a perspective view of an embodiment of a conventional threshold assembly having a threshold base including a threshold body covered by a tread plate, and a threshold cap.

Cap flange 24 may be securely clamped between threshold cap 14 and threshold base 30 to secure shield 10 to the threshold assembly. This clamping effect, combined with the retaining properties of hook 18, allows shield 10 to be retained securely on the threshold base 30 after installation. Thus, shield 10 provides protection to threshold base 30, including base support 30*a* and tread plate 12 that may be installed on the base 30 in some embodiments. For example, as seen in FIG. 3, a threshold assembly 100 includes a threshold base 30 having a base support 30*a* covered by a tread plate 12. Base support 30*a* in some applications includes wood, and tread plate 12 may include a different material such as metal or plastic. Tread plate 12 may include a tread pattern or roughened surface to provide traction when people walk on threshold 100. Tread plate 12 generally includes a longitudinal tread plate front edge 46 positioned at the forward edge of the tread plate 12. The tread plate front edge 46 may extend beyond the front base edge 44, as seen in FIG. 3, in some embodiments. Tread plate front edge 46 may include one or more recessions or grooves, and in some embodiments hook 18 is shaped to engage a corresponding longitudinal groove in tread plate front edge 46. Also seen in FIG. 3, in some embodiments, one or more tread plate seals 32 may be located on threshold 100 between tread plate 12 and threshold cap 14.

Figure 4:
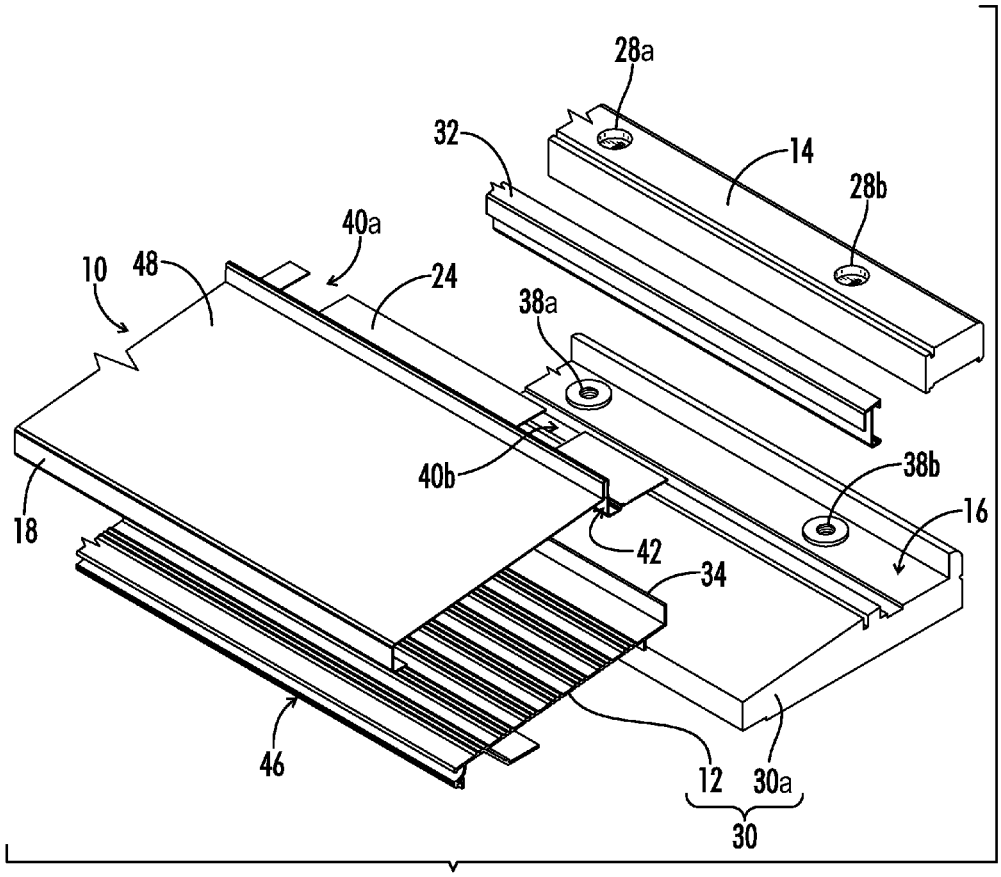
FIG. 4 illustrates an exploded perspective view of a threshold assembly and a door threshold shield apparatus in accordance with some embodiments of the present invention.

Referring further to FIG. 3, in some embodiments, threshold cap 14 may be selectively removable from threshold base 30 using one or more threshold cap fasteners 36*a*, 36*b* extending through a corresponding cap fastener hole 28*a*, 28*b* defined through threshold cap 14. Each threshold cap fastener 36*a*, 36*b* engages a corresponding fastener hole 38*a*, 38*b* formed in threshold base 30 or another structure below threshold cap 14, as seen in FIG. 4. By tightening each threshold cap fastener 36*a*, 36*b*, threshold cap 14 may be tightened against cap flange 24 when cap flange 24 is positioned between threshold cap 14 and threshold base 30. This allows cap flange 24 to be rigidly clamped between threshold cap 14 and threshold base 30.

Figure 5:
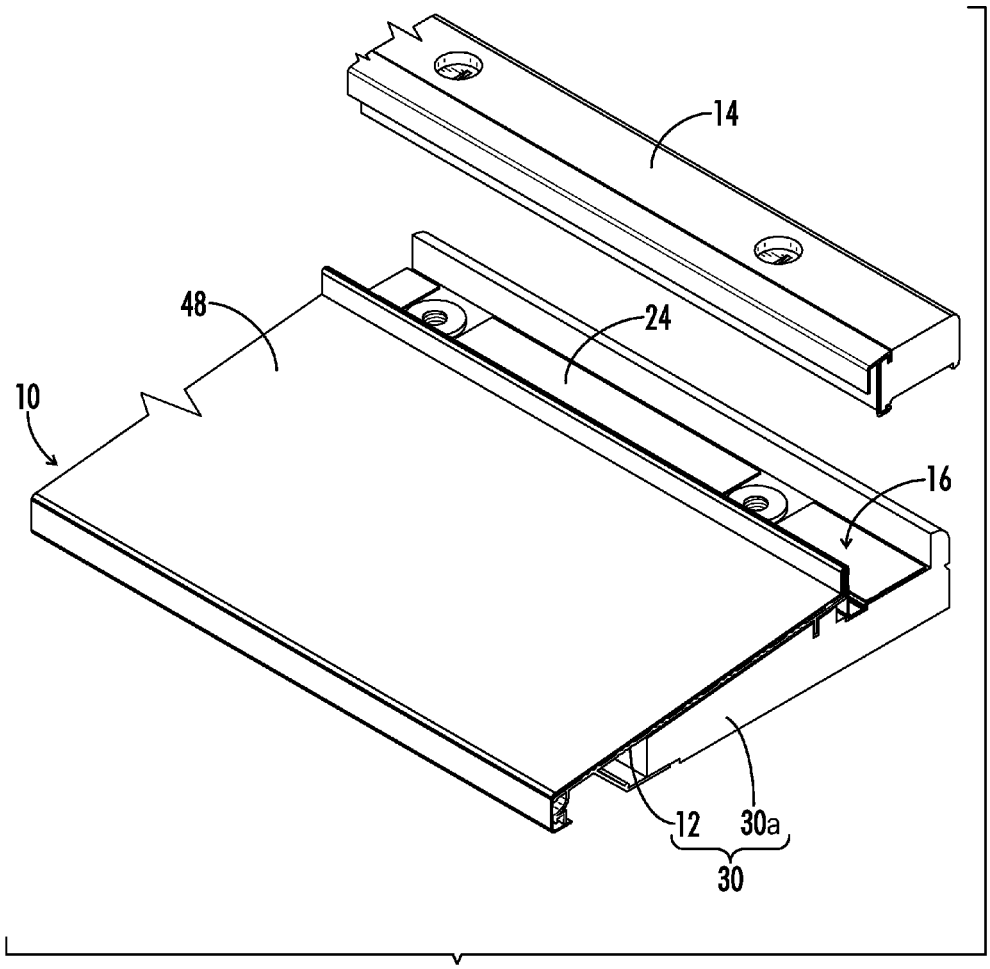
FIG. 5 illustrates a partially exploded perspective view of the embodiment of a threshold assembly of FIG. 6 with the door threshold shield apparatus installed on the threshold base.

As seen in FIG. 4, in some embodiments, cap flange 24 includes one or more fastener openings 40*a*, 40*b* defined in cap flange 24. Each fastener opening 40*a*, 40*b* is positioned at a longitudinal position along cap flange 24 to correspond with the location of cap fasteners 36*a*, 36*b*. As such, each fastener opening 40*a*, 40*b* provides a clearance to allow passage of a corresponding cap fastener 36*a*, 36*b* to access a fastener hole, as seen in FIG. 5. Each fastener opening 40*a*, 40*b* may be defined as a hole or cutout in cap flange 24 in some embodiments.

Figure 6:
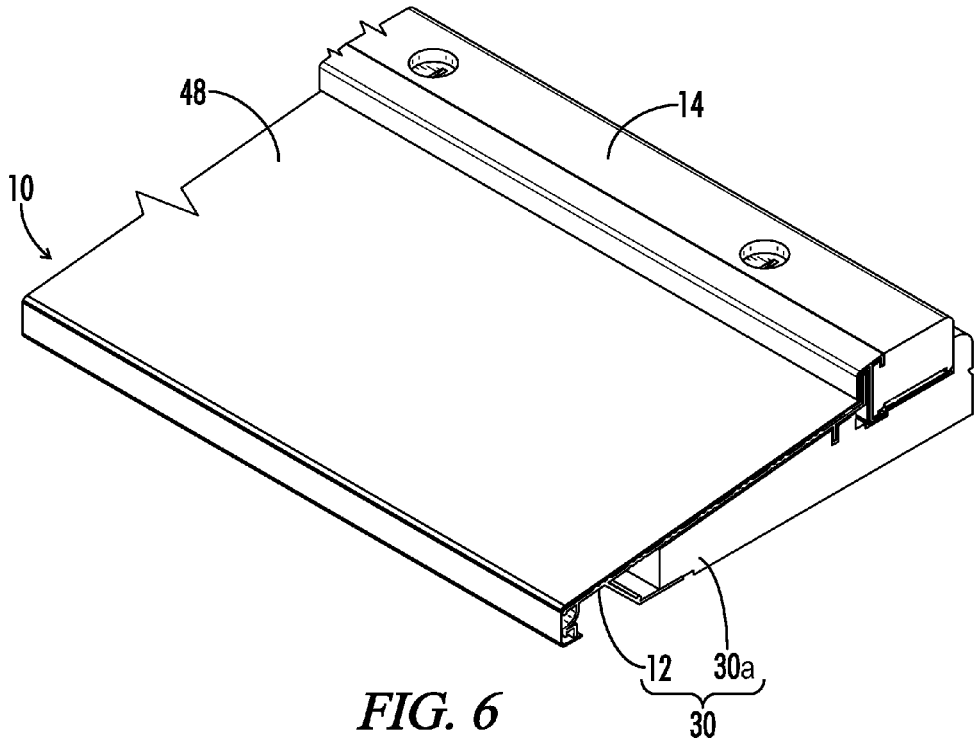
FIG. 6 illustrates a perspective view of an embodiment of a threshold assembly including a door threshold shield apparatus in accordance with the present invention.

Referring further to FIGS. 4-6, in some embodiments, threshold base 30 includes a cap channel 16, or cap recess in threshold body 30. As seen in FIG. 4, cap channel 16 may be integrally defined in the base support 30*a* portion of threshold base 30. Alternatively, cap channel 16 may be formed by one or more additional features added to base support 30*a* forming a gap between pieces. Cap flange 24 is positioned on shield 10 to extend into cap channel 16 in some embodiments.

A cover flange 34 may extend upwardly from tread plate 12 in some embodiments, as shown in FIG. 4. Cover flange 34 abuts threshold cap 14 and provides engagement with cap seal 32 in some applications. In some embodiments, shield body 48 includes a longitudinal flange housing 42 positioned near the second longitudinal edge 26. Flange housing 42 provides a vacant region shaped to receive cover flange 34. Flange housing 42 in some embodiments includes a folded portion of the integral sheet metal of shield 10. Offset region 50 may extend downwardly from the flange housing 42 for connecting cap flange 24 to shield body 48 in some applications. Alternatively, offset region 50 may be laterally spaced from flange housing 42. Flange housing 42 is integrally formed between second longitudinal edge 26 and cap flange 24 in some embodiments. Flange housing 42 is positioned on shield 10 in some embodiments to fit under a portion of cap seal 32, as seen in FIG. 7A. This allows a beneficial seal between shield 10 and threshold cap 14 to prevent debris from entering a space between shield 10 and threshold cap 14. Flange housing 42 is folded between a portion of cap seal 32 and cover flange 34 on tread plate 12 in some embodiments.

In some applications, cap flange 24 extends from second longitudinal edge 26 below the plane of shield body 48, as seen in FIG. 5 such that cap flange 24 rests in the trough of cap channel 16 when shield 10 is installed on the threshold base 30. Cap flange 24 is contoured to fit the profile of the trough of cap channel 16, as shown in FIG. 7A, in some embodiments.

When shield 10 is installed on threshold base 30, shield 10 is retained in place using at least two points of attachment in some embodiments. A first point of attachment is provided along the front longitudinal edge of base 30 by hook 18. A second point of attachment is provided by cap flange 24 clamped between threshold cap 14 and threshold base 30. By providing two points of attachment, shield 10 may be retained securely on threshold base 30 either before or after threshold 100 has been installed on a floor. Shield 10 may be removed simply by removing or loosening threshold cap 14 and disengaging hook 18 from the front longitudinal edge of threshold base 30. In some applications, shield 10 may be disposable or recyclable after removal from threshold base 30. Alternatively, shield 10 may be reusable on a different threshold base.

Figure 7:
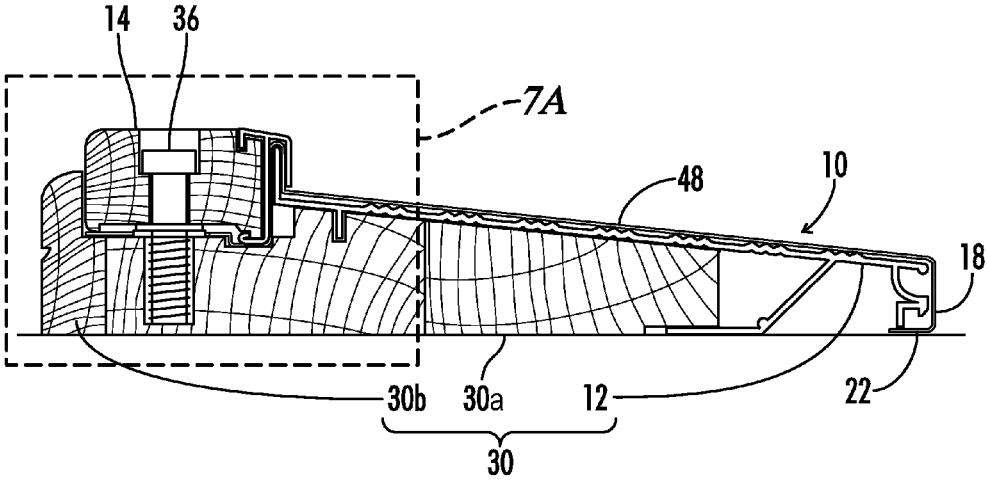
FIG. 7 illustrates a detail cross-sectional view of an embodiment of a threshold assembly including a door threshold shield apparatus in accordance with the present invention.
Figure 7A:
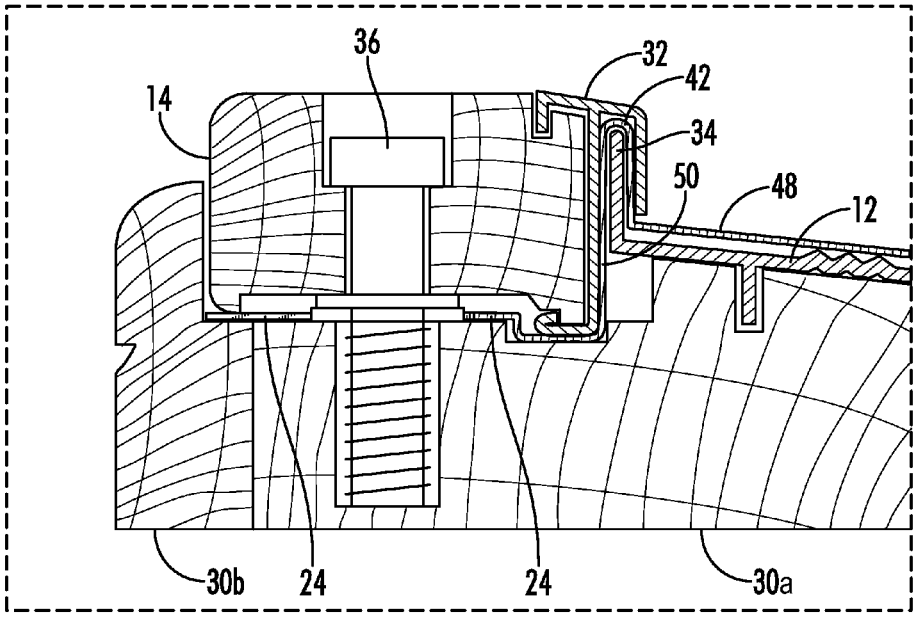
FIG. 7A illustrates a detail cross-sectional view of Section 7A from FIG. 7.
Figure 8:
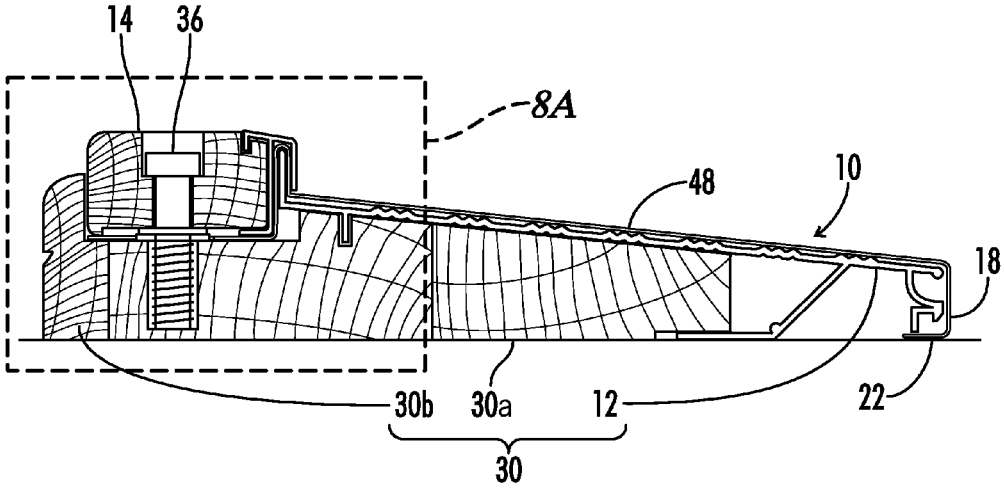
FIG. 8 illustrates a detail cross-sectional view of an embodiment of a threshold assembly including a door threshold shield apparatus in accordance with the present invention.
Figure 8A:
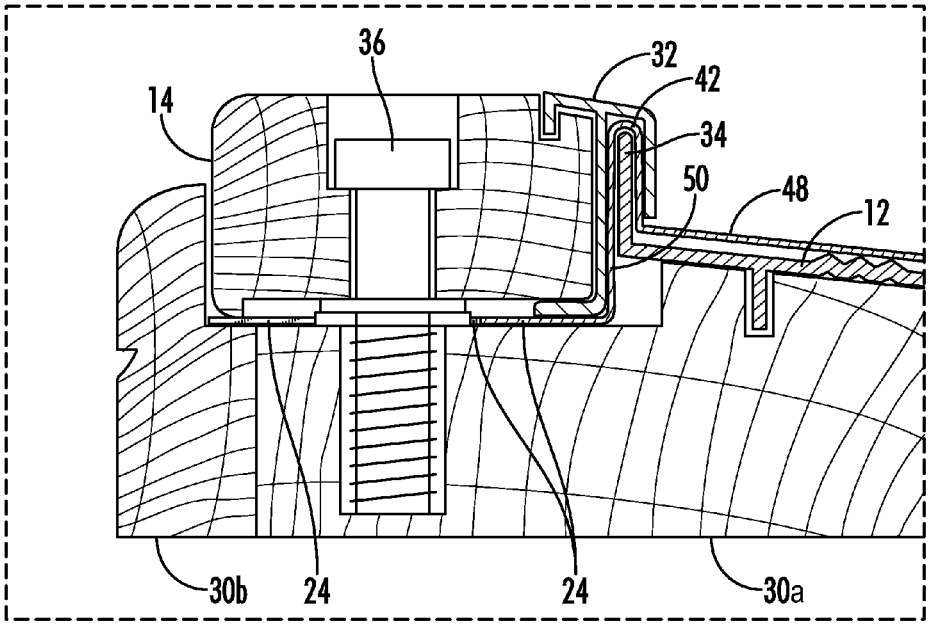
FIG. 8A illustrates a detail cross-sectional view of Section 8A from FIG. 8.

Referring now to FIG. 7, a cross-sectional view of an embodiment of a shield apparatus 10 is shown installed on a threshold base 30. Shield 10 includes a hook 18 positioned under the front longitudinal edge of tread plate 12. As seen in FIG. 7 and FIG. 7A, threshold base 30 includes a first base support 30*a* and a second base support 30*b*. Multiple base support portions 30*a*, 30*b* may be joined together to form threshold base 30 in some embodiments.

In some embodiments, the present invention also provides a complete threshold assembly including a threshold base 30, a removable cap 14 positioned on the threshold base 30, and a shield 10 positioned over the threshold base 30. Shield 10 includes a shield body 48 covering a portion of the threshold base 30 and a cap flange 24 protruding from the shield body 48. Cap flange 24 is clamped between the threshold base 30 and the threshold cap 14. Shield 10 also includes a hook 18 in some applications. The threshold assembly may be provided pre-assembled as a complete threshold unit for installation in a doorway at a construction location.

Thus, although there have been described particular embodiments of the present invention of a new and useful Doorway Threshold Shield Apparatus, it is not intended that such references be construed as limitations upon the scope of this invention except as set forth in the following claims.

What is claimed is:

1. A shield apparatus for covering a threshold of the type having a threshold base and a threshold cap, the shield apparatus comprising:

a shield body shaped to cover a portion of the threshold base, the shield body having a first longitudinal edge and a second longitudinal edge;

a hook extending downwardly from the first longitudinal edge;

a cap flange protruding from the second longitudinal edge, the cap flange shaped to be clamped between the threshold cap and the threshold base; and at least one cap flange fastener opening defined in the cap flange.

2. The apparatus of claim 1, further comprising:

the threshold base including a cap channel recessed into the threshold base;

wherein the cap flange is configured to fit into the cap channel between the threshold cap and the threshold base.

3. The apparatus of claim 2, further comprising an offset member between the shield body and the cap flange.

4. The apparatus of claim 3, wherein the offset member extends downwardly from the second longitudinal edge of the shield body.

5. The apparatus of claim 4, wherein the offset member is shaped to extend into the cap channel.

6. The apparatus of claim 3, wherein the hook includes a hook flange shaped to extend under the threshold base.

7. The apparatus of claim 1, wherein the hook includes a hook flange shaped to extend under the threshold base.

8. The apparatus of claim 1, wherein the shield body comprises metal.

9. The apparatus of claim 1, wherein the shield body comprises plastic.

* * * * *